US010060232B2

(12) United States Patent
Johnson et al.

(10) Patent No.: US 10,060,232 B2
(45) **Date of Patent: *Aug. 28, 2018**

(54) MULTI-LAYERED WELLBORE COMPLETION FOR METHANE HYDRATE PRODUCTION

(71) Applicant: Baker Hughes, a GE company, LLC, Houston, TX (US)

(72) Inventors: Michael H. Johnson, Katy, TX (US); Mark K. Adam, Houston, TX (US); Bennett M. Richard, Kingwood, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/664,516

(22) Filed: Jul. 31, 2017

(65) Prior Publication Data

US 2017/0328183 A1 Nov. 16, 2017

Related U.S. Application Data

(60) Division of application No. 14/447,009, filed on Jul. 30, 2014, now Pat. No. 9,725,990, which is a continuation-in-part of application No. 14/023,982, filed on Sep. 11, 2013, now Pat. No. 9,097,108.

(51) Int. Cl.
*E21B 43/08* (2006.01)

(52) U.S. Cl.
CPC ..... *E21B 43/082* (2013.01)

(58) Field of Classification Search
CPC ..... E21B 43/082
USPC ..... 166/276
See application file for complete search history.

(56) References Cited

U.S. PATENT DOCUMENTS 6,148,911 A 11/2000 Gipson et al.
6,848,505 B2 * 2/2005 Richard ..... E21B 43/103 166/285
7,413,022 B2 8/2008 Broome et al.
7,578,343 B2 8/2009 Augustine
7,743,835 B2 6/2010 Willauer
(Continued)

FOREIGN PATENT DOCUMENTS

WO 2008151311 A2 12/2008
WO 2010045077 A2 4/2010
(Continued)

*Primary Examiner* — Silvana C Runyan
(74) *Attorney, Agent, or Firm* — Steve Rosenblatt

(57) ABSTRACT

In a completion for producing methane the bottom hole assembly has a base pipe with porous media surrounding it for equalizing flow along the base pipe. A shape memory polymer foam surrounds the porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

23 Claims, 2 Drawing Sheets

(56) References Cited

U.S. PATENT DOCUMENTS

| | | | | |
|---|---|---|---|---|
| 7,832,477 | B2 * | 11/2010 | Cavender | E21B 43/26 166/206 |
| 7,832,490 | B2 | 11/2010 | Willauer | |
| 7,921,915 | B2 | 4/2011 | Richard et al. | |
| 7,926,565 | B2 | 4/2011 | Duan et al. | |
| 7,954,546 | B2 | 6/2011 | Kim et al. | |
| 8,048,348 | B2 | 11/2011 | Duan et al. | |
| 8,225,863 | B2 | 7/2012 | Hammer et al. | |
| 8,353,346 | B2 | 1/2013 | Johnson et al. | |
| 9,097,108 | B2 * | 8/2015 | Johnson | E21B 43/108 |
| 2003/0075333 | A1 | 4/2003 | Vercaemer et al. | |
| 2004/0104052 | A1 | 6/2004 | Livingstone | |
| 2004/0177961 | A1 | 9/2004 | Nguyen | |
| 2004/0261994 | A1 | 12/2004 | Nguyen et al. | |
| 2007/0144741 | A1 | 6/2007 | Cho et al. | |
| 2007/0227731 | A1 | 10/2007 | Contant | |
| 2008/0072495 | A1 | 3/2008 | Waycuilis | |
| 2008/0296020 | A1 | 12/2008 | Willauer | |
| 2008/0296023 | A1 | 12/2008 | Willauer | |
| 2009/0032244 | A1 | 2/2009 | Zupanick | |
| 2009/0078419 | A1 | 3/2009 | Dusterhoft | |
| 2009/0101353 | A1 | 4/2009 | Crow et al. | |
| 2009/0178805 | A1 | 7/2009 | Yemington | |
| 2010/0077594 | A1 | 4/2010 | Richard | |
| 2010/0089565 | A1 | 4/2010 | Duan et al. | |
| 2010/0294513 | A1 | 11/2010 | Van Nieuwkoop | |
| 2011/0067872 | A1 | 3/2011 | Agrawal | |
| 2011/0073293 | A1 | 3/2011 | Gauthier et al. | |
| 2011/0162780 | A1 | 7/2011 | Duan et al. | |
| 2011/0232901 | A1 | 9/2011 | Carrejo et al. | |
| 2011/0252781 | A1 | 10/2011 | Johnson et al. | |
| 2011/0259587 | A1 | 10/2011 | Joseph et al. | |
| 2012/0145389 | A1 | 6/2012 | Fitzpatrick, Jr. | |
| 2012/0181017 | A1 | 7/2012 | Hart et al. | |
| 2012/0247761 | A1 | 10/2012 | O'Malley | |
| 2013/0062067 | A1 | 3/2013 | Guest et al. | |
| 2013/0068481 | A1 | 3/2013 | Zhou et al. | |
| 2013/0090854 | A1 | 4/2013 | Rasmus et al. | |
| 2013/0126170 | A1 | 5/2013 | Johnson et al. | |
| 2013/0206406 | A1 | 8/2013 | Kuo et al. | |

FOREIGN PATENT DOCUMENTS

| | | | |
|---|---|---|---|
| WO | 2011037950 | A2 | 3/2011 |
| WO | 2011133319 | A2 | 10/2011 |
| WO | 2011162895 | A2 | 12/2011 |

* cited by examiner

MULTI-LAYERED WELLBORE COMPLETION FOR METHANE HYDRATE PRODUCTION

CROSS REFERENCE TO RELATED APPLICATION

This application is a divisional of U.S. patent application Ser. No. 14/447,009, filed on Jul. 30, 2014, which is a continuation-in-part of U.S. application Ser. No. 14/023,982, filed on Sep. 11, 2013, now U.S. Pat. No. 9,097,108, for "Wellbore Completion for Methane Hydrate Production", and claims the benefit of priority from the aforementioned application.

FIELD OF THE INVENTION

The field of this invention is completions and more particularly in unconsolidated formations that produce methane hydrate where there is a need for sand control and flow distribution to protect the screen while stabilizing the borehole.

BACKGROUND OF THE INVENTION

Methane hydrate exists as a solid substance in layers that contain sand and other sediment. Hydrate to methane gas and water must be accomplished in order to produce the methane gas. The production of methane hydrate means dissociating methane hydrate in the layers and collecting the resultant methane gas through wells and production systems. To dissociate methane hydrate that is stable at low temperature and under high pressure, there must be an (1) increase the temperature, (2) decrease the pressure, (3) or both. The optimum methane hydrate production method is one based on the "depressurization method." However, since methane hydrate layers are unconsolidated sediments, sand production occurs with the methane gas and water. Because removal of the methane, water, and sand, wellbore stability becomes an issue that cannot be overcome with conventional sand control methodologies. Economical and effective measures for preventing sand production and solving borehole stability issues require a novel approach to completion methodology.

The proposed method to control sand production and provide better borehole stability comprises providing a shape memory polymer foam filter that does not depend on the borehole for containment for sand management. The shape memory polymer will be utilized such that a flow path would not be exposed that would permit the production of sand from the borehole. One other issue related to the depressurization method of methane hydrate production is the uniform application of a differential pressure across the reservoir interface. The method further comprises a porous media under the shaped memory polymer foam filter that can be varied in number and permeability to balance the differential pressure applied to the reservoir being produced. This improves borehole stability via uniform drawdown and flow from the exposed reservoir. While these techniques could be used in a conventional open hole or cased hole completion, it is desirable to under ream or expand the borehole size to help increase wellbore radius and decrease flow velocities at the sand management/reservoir interface. Additionally, consolidated proppant or sand could be deposited adjacent the shape memory foam as it is not the objective to fully occupy the borehole with the foam after it crosses its critical temperature. Instead, in recognition that the hole can be enlarged with initial reaming to reduce fluid velocities or alternatively additional methane production destabilizes the formation and can enlarge the borehole, the consolidated proppant or sand can be an outer protective layer to the foam. Its ability to self-adhere contains the foam and protects the foam from erosive velocity effects of the produced methane.

Several references that employ memory foam in sand control applications are as follows:

WO/2011/162895A;
8353346
US20110252781
WO/2011/133319A2
US20130062067
WO/2013/036446A1
US20130126170
8048348
US20100089565
US20110162780
7926565
WO/2010/045077A2
US20110067872
WO/2011/037950A2
7832490
US20080296023
US20080296020
7743835
WO/2008/151311A3

Flow balancing devices are generally discussed in the following references:

7954546
7578343
8225863
7413022
7921915

A need exists for an assembly and method of producing methane from an unconsolidated formation surrounding a borehole having methane hydrate, sand or other sediments. Once positioned and set near the formation, the filtration assembly should be able to manage sand and other sediments without having to rely on the geometric configuration of the borehole for containment, such that should the surrounding borehole subsequently enlarge or the space between the formation and the assembly increase due to changing reservoir conditions the geometric configuration of the assembly will not substantially change.

Those skilled in the art will better appreciate additional aspects of the invention from a review of the detailed description of the preferred embodiment and the associated drawings while appreciating that the full scope of the invention is to be determined by the appended claims.

SUMMARY OF THE INVENTION

In a completion for producing methane the bottom hole assembly has a base pipe with porous media within it for equalizing flow along the base pipe. A shape memory polymer foam surrounds the base pipe with porous media. The borehole can be reamed to reduce produced methane velocities. Surrounding the shape memory polymer is an exterior layer of consolidated proppant or sand that can self-adhere and/or stick to the polymer foam. The proppant or sand can be circulated or squeezed into position although, circulation is preferred. The borehole may enlarge due to shifting sands in an unconsolidated formation as the methane is produced. The bottom hole assembly helps in fluid flow equalization and protects the foam and layers below from high fluid velocities during production.

DETAILED DESCRIPTION OF THE PREFERRED EMBODIMENT

Figure 1:
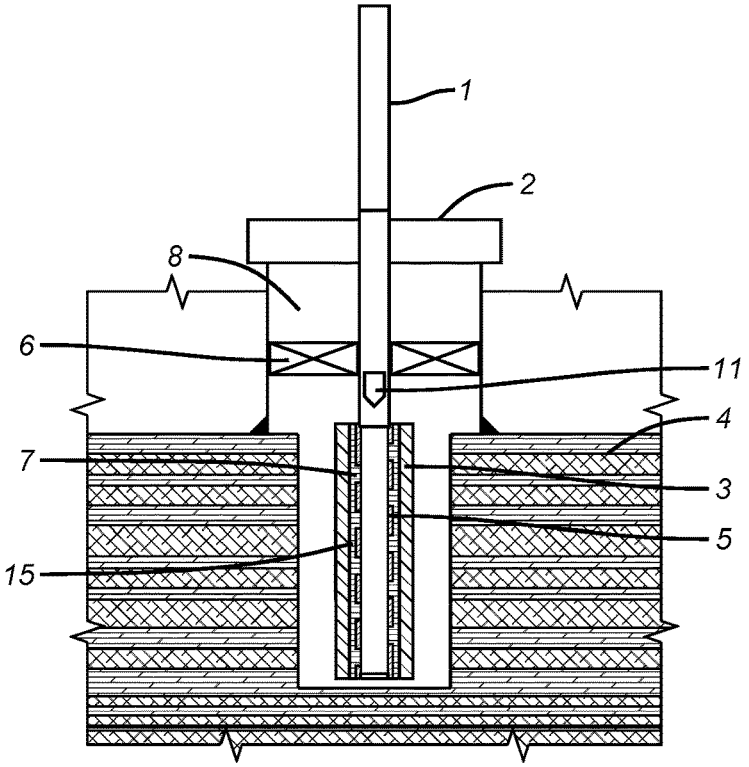
FIG. 1 shows the run in position of the bottom hole assembly with the shape memory polymer foam as yet unexpanded.

In broad terms the preferred embodiment can be described as a filtration assembly and method of producing methane from methane hydrate in an unconsolidated formation containing sand and other sediments. The filtration assembly comprises a bottom hole assembly comprising a sand control assembly and a base pipe. The sand control assembly comprises a shape memory porous material, which is adapted to surround the base pipe and form a first discrete filtration layer. In one embodiment, to assist in filtering sand and other sediments from the methane a second discrete filtration layer is placed over the first discrete filtration layer comprising consolidated proppant, gravel or sand, or any combination thereof, that can adhere either to each other, the first discrete filtration layer, or both, and remain adhered should reservoir conditions change. The second discrete filtration layer may be circulated or squeezed into position after the bottom hole assembly has been positioned near the formation, or run in as part of the bottom hole assembly, although circulation is preferred. In an alternative embodiment, the third discrete filtration layer is located under the first discrete filtration layer and comprises one or more filtration assurance devices adapted to support the first discrete filtration layer, assist in filtering sediment from the methane, or aid in depressurization of the formation, or any combination thereof, such as wire mesh, prepack screen or beadpack.

In a preferred embodiment, the shape memory porous material is an open-cell shape memory foam, such as the foam described in the list of memory foam patents and patent applications referenced above, and the memory foam marketed by Baker Hughes Incorporated under the trademark GEOFORM™. The memory foam is adapted to help manage sand production by inhibiting the formation of a flow path through the filtration layer in which sand may be produced and by providing borehole stability without having to depend on containment by the surrounding borehole.

To dissociate methane from methane hydrate, a depressurization method is employed by applying a differential pressure across the reservoir interface between the bottom hole assembly and the formation, using, for example, an electric submersible pump. As the methane dissociates from methane hydrate it passes through the filtration assembly, which filters sand and other sediments from the methane and allows the methane to enter the base pipe. In one embodiment, the base pipe comprises a depressurization device designed to help equalize flow along at least one interval of the base pipe and protect the filtration layers from high fluid velocities during production. As previously mentioned, however, the third discrete filtration layer when located under the first discrete filtration layer may also serve as a means of assisting in the depressurization of the formation. The borehole may also be reamed to reduce methane production velocities.

When the borehole subsequently enlarges or the space between the formation and the bottom hole assembly increases due to changing reservoir conditions (e.g., shifting of sands or other sediments in an unconsolidated formation as the methane is produced) the geometric configuration of the bottom hole assembly will not substantially change.

Referring to FIG. 1 a work string 1 is run through a wellhead 2. The bottom hole assembly comprises a base pipe 5 with openings. A production packer 6 isolates the methane hydrate reservoir 4. A schematically illustrated crossover tool 11 allows placement of the consolidated proppant or sand (gravel) 9 about the shape memory polymer foam 3. See FIG. 3. In one embodiment, the base pipe 5 has depressurization devices 7, such as an annularly shaped porous member of different thicknesses and porosities, or a housing having one or more tortuous paths of different resistances to fluid flow, adapted to help equalize flow along at least one interval of the base pipe and help protect the filtration layers from high fluid velocities during production such as a choke valve, bead pack, prepack screen or wire mesh 15.

In one embodiment, the base pipe comprises a depressurization device for balancing flow along at least one interval of the base pipe, or a selectively or automatically adjustable inflow control member (e.g., an adjustable valve or tubular housing having one or more inflow passages, preferably with a tortuous pathway). See for example, U.S. Pat. Pub. No. 2013/0180724 and flow control products marketed by Baker Hughes Incorporated (United States of America) under the trademark EQUALIZER™.

Figure 2:
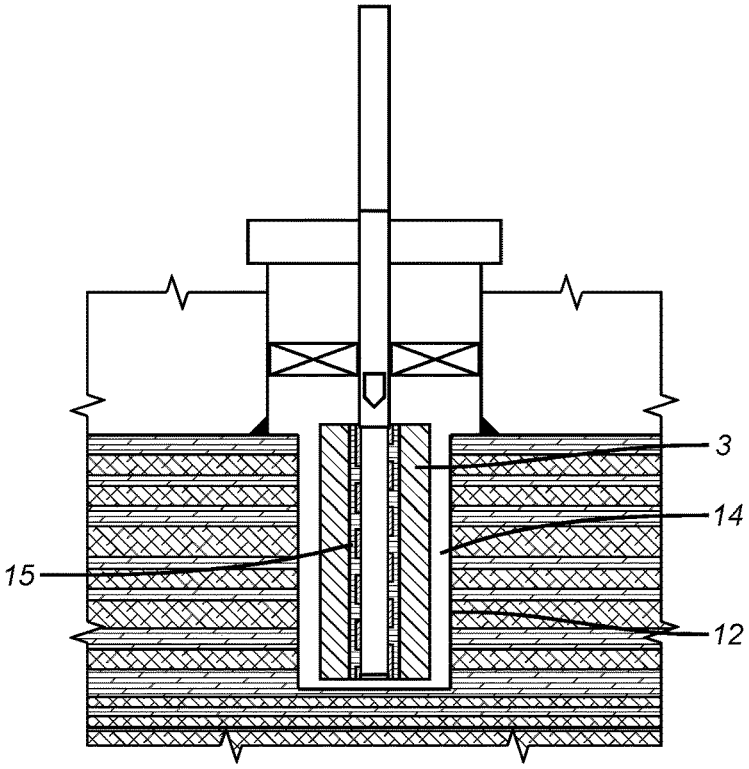
FIG. 2 is the view of FIG. 1 with the polymer foam expanded.
Figure 3:
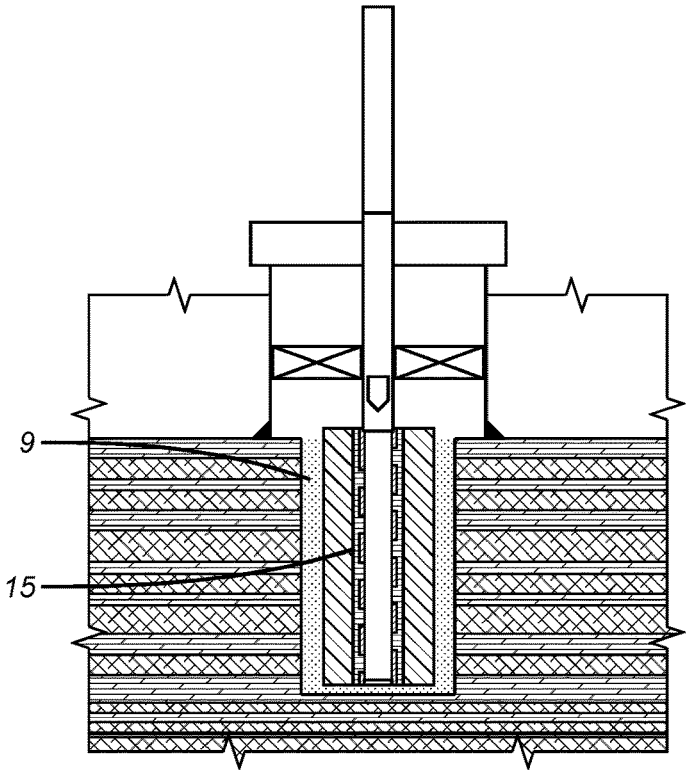
FIG. 3 is the view of FIG. 2 with the consolidated proppant or gravel in position.
Figure 4:
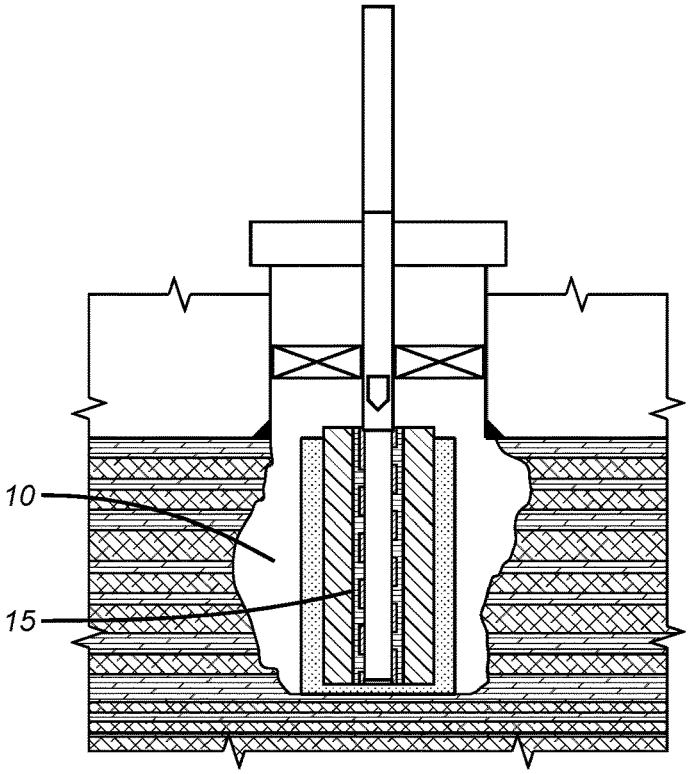
FIG. 4 is the view of FIG. 3 showing the shifting of the unconsolidated borehole wall during methane production.

In FIG. 1 the memory polymer foam 3 is in its run in dimension where it has not yet been warmed above its transition temperature. In FIG. 2 the transition temperature has been reached and the polymer foam 3 has expanded to a location still short of the borehole wall 12 to leave an annular gap 14 into which the proppant or sand 9 will be deposited using the crossover 11 as illustrated in FIG. 3. This is done preferably with circulation with crossover 11 and using a wash pipe that is not shown to direct returns that come through the proppant/sand 9 and the memory foam 3 into the upper annulus 8 above the packer 6. Finally, FIG. 4 illustrates the onset of methane production that ensues when the pressure in the formation 4 is allowed to be reduced. With the removal of methane a large void volume 10 can be created. This has the beneficial effect of reduction of fluid velocities for the methane. Those skilled in the art will appreciate that the initial deposition of the proppant or sand 9 could likely fill the remaining annular space around the memory foam 3 by virtue of the addition of the proppant or sand 9 until some pressure resistance is sensed at the surface indicating that the volume in the annulus has packed in. The delivery of the proppant or sand 9 can begin before, during or after the foam 3 reaches its critical temperature and grows dimensionally. In any of those cases the production of methane can hollow out the reservoir as shown in FIG. 4 so the adherence of the proppant or sand 9 to itself and to the foam helps to keep the components within the foam 3 protected from erosive high gas velocities. The enlarging of the borehole as well as the flow balancing devices 7 also helps to control high velocity gas erosion to keep the bottom hole assembly serviceable for a longer time before a workover is needed.

The combination of flow balancing with the self-adhering proppant or sand 9 covering the memory polymer foam 3 and to some extent adhering to the foam allows for a longer service life as the layers of filtration remain serviceable longer in adverse conditions such as borehole collapse and potential for erosion caused at least in part by flow imbalance induced high gas velocities.

The proppant/sand 9 can be a commercially available product such as Sandtrol®. The foam is available as GeoFORM®. Alternatives can be alloy memory foam or screens of various designs that do not change dimension with thermal stimulus. The screens can be constructed so that they can be radially expanded for borehole support or to reduce the volume needed for the proppant/sand 9. The flow balancing feature can be a porous annular shape or insert plugs in the base pipe or screen materials that vary in mesh size at different opening locations.

The above description is illustrative of the preferred embodiment and many modifications may be made by those skilled in the art without departing from the invention whose scope is to be determined from the literal and equivalent scope of the claims below:

We claim:

1. A completion method for methane production from methane hydrate, comprising:

running in a bottom hole assembly to an isolated producing zone;

providing a plurality of filtration layers with at least one inner layer on said bottom hole assembly and another outer layer that is independently delivered to said at least one inner layer when said inner layer is in said producing zone;

adhering components of said outer layer to each other or to said at least one inner layer such that said inner and outer layers remain adjoining when the borehole enlarges and moves away from said outer layer as methane is produced;

wherein said at least one inner layer is made from at least one of wire screen, a bead pack, prepack screen and a shape memory porous material.

2. The method of claim 1, comprising:

delivering said outer layer with circulation that returns to the surface through an upper annulus above a production packer.

3. The method of claim 1, comprising:

delivering said outer layer through a crossover tool while squeezing a carrier fluid into the adjacent formation.

4. The method of claim 1, comprising:

reaming the borehole before running in said bottom hole assembly.

5. The method of claim 1, comprising:

using a base pipe with multiple openings to conduct methane through said bottom hole assembly;

providing a flow balancing feature in at least one of said openings.

6. The method of claim 5, comprising:

using an annular porous member adjacent at least one said opening for said flow balancing.

7. The method of claim 5, comprising:

providing a member that provides a tortuous path in at least one said opening for flow balancing.

8. The method of claim 1, comprising:

using a shape memory porous material as said at least one inner layer.

9. The method of claim 8, comprising:

bringing said shape memory porous material to beyond its critical temperature while leaving open a surrounding annular gap for the delivery of said outer layer after enlargement of said shape memory material.

10. The method of claim 8, comprising:

using a shape memory polymer foam as said at least one inner layer.

11. The method of claim 10, comprising:

retaining components of said outer layer to said shape memory polymer foam.

12. The method of claim 10, comprising:

retaining said components of said outer layer to each other to hold shape when said borehole enlarges as methane is produced.

13. An assembly for producing methane from an unconsolidated formation surrounding a borehole comprising methane hydrate, sand or other sediments, said assembly comprising:

a bottom hole assembly for running into the borehole comprising a plurality of filtration layers;

said filtration layers comprising at least one inner layer and at least one outer layer;

said outer layer delivered to the borehole to contact said inner layer already in the borehole;

wherein said at least one outer layer comprises components adapted to either adhere to each other, said at least one inner layer, or both, and remain adhered should the borehole enlarge or the space between the formation and said outer layer increase.

14. The assembly of claim 13, wherein said outer layer is delivered to said bottom hole assembly using circulation that returns to the surface through an upper annulus.

15. The assembly of claim 13, wherein said outer layer is delivered to said bottom hole assembly through a crossover tool by a carrier fluid flowed into an adjacent formation.

16. The assembly of claim 13, wherein said components of said outer layer are assembled with said bottom hole assembly after said bottom hole assembly is run into the borehole.

17. The assembly of claim 13, wherein said at least one inner layer is a shape memory porous material.

18. The assembly of claim 17, wherein said shape memory porous material is a shape memory polymer foam.

19. The assembly of claim 13, wherein at least an interval of said bottom hole assembly comprises a base pipe with a plurality of openings adapted to conduct methane therethrough.

20. The assembly of claim 19, wherein said bottom hole assembly further comprises a flow balancing device adjacent or near at least one of said plurality of openings.

21. The assembly of claim 20, said flow balancing device is an annular porous member.

22. The assembly of claim 20, wherein said flow balancing device is a housing adapted to allow for the flow balancing of methane through said at least one of said plurality of openings by creating a tortuous path.

23. An assembly for producing methane from an unconsolidated wellbore formation surrounding a borehole comprising methane hydrate, sand or other sediments, said assembly comprising:

a bottom hole assembly for running into the borehole near the unconsolidated wellbore formation comprising a plurality of filtration layers comprising at least one inner layer and at least one outer layer;

said at least one inner layer comprises a filter;

said at least one outer layer comprises a shape memory porous material;

wherein said shape memory porous material is maintained in a compressed position during run at a temperature below its glass transition temperature, and expands during set position as it is heated to a temperature near or above its glass transition temperature; and wherein said shape memory porous material is adapted such that in the expanded set position, said shape memory porous material does not make substantial, if any, contact with the surrounding formation.

* * * * *